United States Patent [19]

Maublanc

[11] 4,369,545

[45] Jan. 25, 1983

[54] DOUBLE ACTION DOOR CLOSURE MECHANISM

[75] Inventor: Georges Maublanc, St. Germain du Plain, France

[73] Assignee: Pont-A-Mousson S.A., Nancy, France

[21] Appl. No.: 205,496

[22] Filed: Nov. 10, 1980

[30] Foreign Application Priority Data

Nov. 15, 1979 [FR] France ..... 79 28192

[51] Int. Cl.[3] ..... E05F 3/00

[52] U.S. Cl. ..... 16/64; 16/69; 16/79; 16/DIG. 10

[58] Field of Search ..... 49/336; 16/62, 64, 69, 16/79, DIG. 10, DIG. 21

[56] References Cited

U.S. PATENT DOCUMENTS 1,323,338 12/1919 Voight ..... 16/69
1,759,474 5/1930 Volquardsen ..... 16/79 X
1,989,908 2/1935 Bohnsack et al. ..... 16/64
2,471,707 5/1949 van Veen et al. ..... 16/62
3,624,864 12/1971 Marr ..... 16/62

*Primary Examiner*—Paul A. Bell
*Attorney, Agent, or Firm*—Sughrue, Mion, Zinn, Macpeak & Seas

[57] ABSTRACT

A pinion 9 attached to a door meshes with two parallel racks 10, 11 which face each other. A piston 14, connected by rods 29 to a rotatable lever 25 of a restoration assembly 4 which has a return spring 26 and a shock absorber 27, has an L-shaped pivotable hook 21 behind which a pin 12 of one of the two racks catches at the beginning of the opening. At the end of the closing, immobile stop 17 raises hook 21 to free pin 12. The same process occurs with the other rack to open the door in the other direction. The parts assemble in such a way that the door closure is not very thick and can be mounted directly inside a section of the door.

9 Claims, 6 Drawing Figures

DOUBLE ACTION DOOR CLOSURE MECHANISM

The present invention relates to a double action door closure mechanism designed especially to assure the automatic closing of doors which can be opened in two rotational directions, said door closure containing a spindle whose rotation is linked to the movement of the door and a rotatable lever device connected to a return spring and a shock absorber.

In known double action door closures of this type, the connection between the spindle and the turning lever device is provided by cams. The construction of these double action door closures necessitates tooling cams with relatively complex shapes which, to be of acceptably lasting quality, must have dimensions such that the door closures cannot be mounted directly inside the narrow sections of the door.

In other known door closures the spindle meshes with a rack connected by a rod to a turning lever device. However, this involves only single action door closures, or those which function to open the door in only one direction. Such mechanisms are much less cumbersome, but known rack constructions do not lend themselves to the production of a double action door closure.

The object of the invention is to produce a double action door closure with reduced lateral dimensions. It is characterized by a pinion which permanently meshes with two parallel racks, which face each other, and by selective linkages which, for each rotational direction of the pinion, cause both the interlocking of one of the two racks with the rotatable lever device during the opening movement and also the disengagement of this rack and device at the end of the closing movement.

Due to the presence of the two racks and the selective linkages, one of the racks interlocks with the rotatable lever device in one opening direction while the other rack is engaged with this device in the other opening direction of the door. The thickness of such a door closure can easily be made small enough to permit its insertion into an integral section of a door.

In one embodiment, the selective linkages include an pivotable lever held by the rotatable lever device and having a hook situated in the path of movement or trajectory of each rack, the casing of the door closure comprising a stop engaged by the pivotable lever at the end of the closing movement to push the hook away from the trajectories.

In another variation, the selective linkage comprises a mobile element which, with play, traverses a longitudinal rod of the rotatable lever device. A grooved block portion of each rack pushes the mobile element sideways towards the other rack to engage this element with the other rack when the pinion turns in the corresponding direction.

Other characteristics and advantages of the invention will be apparent from the following description, given as a non-limiting, example and from the annexed drawings in which.

Figure 1:
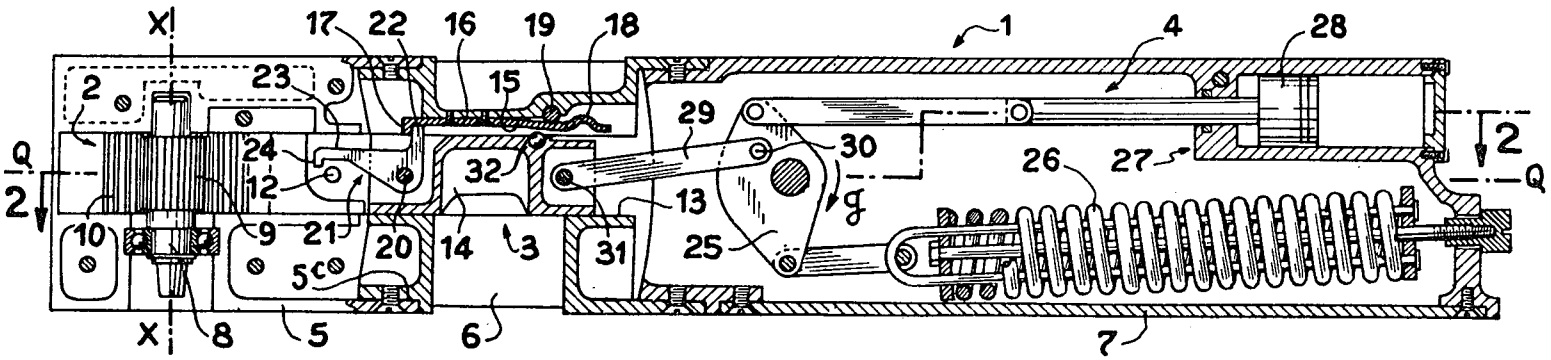
FIG. 1 is a vertical cross-sectional view of a double action door closure, in a rest position.
Figure 2:
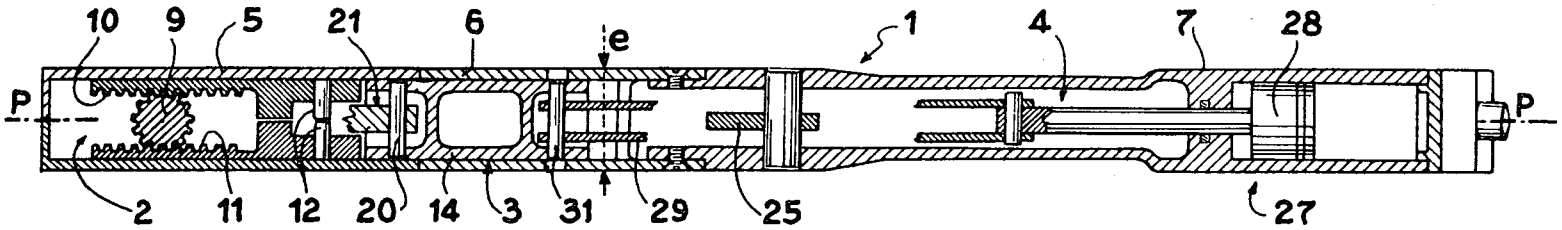
FIG. 2 is a cross-section taken along line 2—2 of FIG. 1.
Figure 3:
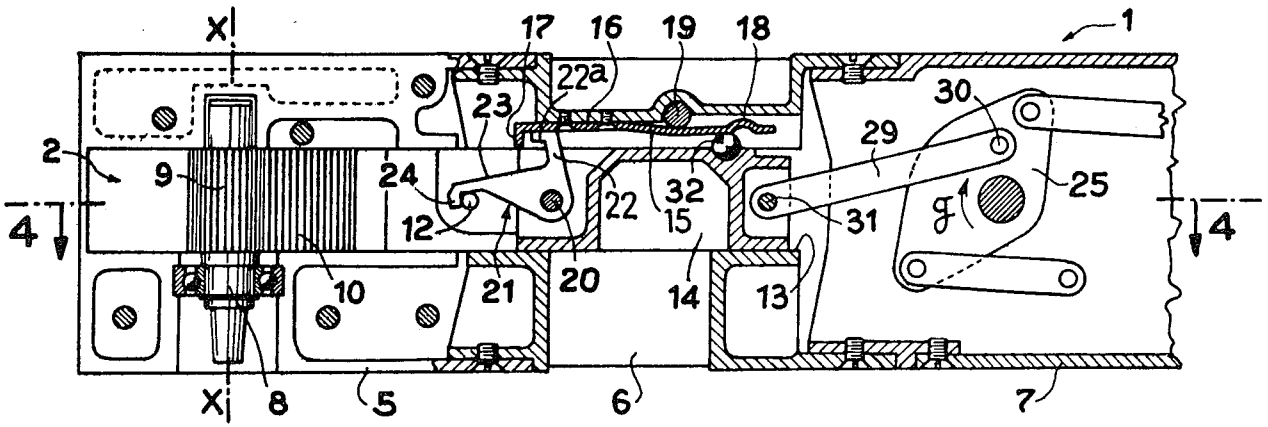
FIG. 3 is an enlarged view of one part of FIG. 1, the door closure being in a door open position.
Figure 4:
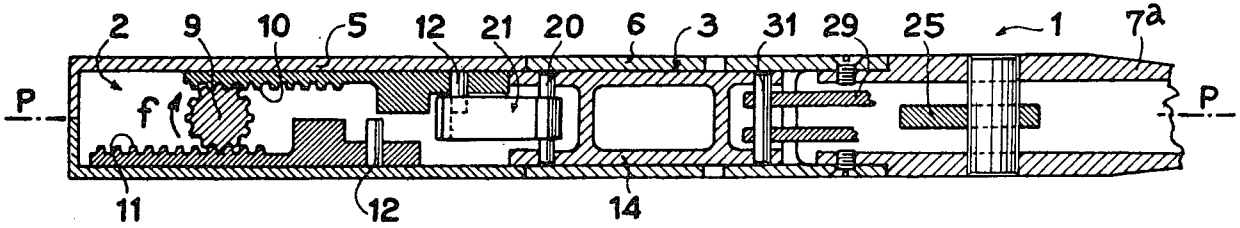
FIG. 4 is a cross-sectional view along line 4—4 of FIG. 3.

Door closure 1 shown in FIGS. 1 to 4 is made of three parts, namely from left to right looking at FIG. 1: a rack and pinion assembly 2, a linkage or connecting assembly 3 and a restoration drive assembly 4. Each assembly 2 to 4 is mounted inside a case, 5 to 7 respectively, these cases being assembled one inside the other so that, after being screwed together, they make up the overall housing of the door closure. This housing has a generally parallelepiped shape whose thickness e (FIG. 2) is small enough so that the door closure can be mounted in a door section or cutout.

Assembly 2 comprises a spindle 8 with a freely rotational but axially fixed axis X—X disposed in case 5.

The intermediate part of this spindle includes pinion 9 which meshes with two rectilinear racks 10 and 11 which each side against opposite side walls of case 5 and which are the mirror images of each other. A slight distance from their right ends, each rack carries a horizontal stop pin 12 directed toward the other rack. In the rest position (FIG. 2), stops 12 are situated as extensions one of the other and the ends of the racks are contained in two vertical planes perpendicular to vertical symmetry plane P of the door closer.

Case 6 of linkage assembly 3 has a rectangular central passage 13 in which parallelepiped piston 14 slides. The upper wall of passage 13 contains a longitudinal groove 15 to which a flexible strip of metal 16 is attached. The left end of the latter is folded under to define a short stop 17, and its right end, which can bend vertically, has a rounded groove 18. Strip 16 is attached by screws in its left portion, and cam 19 which rotates on a horizontal axis allows the adjustment of the height of the portion of this strip between the screws and groove 18.

The left end of piston 14 has a transverse axle 20 on which L-shaped, two-armed lever 21 is loosely mounted. In the rest position, arm 22 is held in a vertical position by stop 17; the other arm 23 protrudes horizontally toward the left, outside of piston 14, and hook 24, pointed downward and which makes up the end of the arm 23, is located above the common horizontal plane of stop pins 12.

The restoration drive assembly 4 comprises a rotatable lever 25 with a horizontal axis. One arm of the lever is connected to adjustable compression spring 26 and the other to hydraulic shock absorber 27, also adjustable, having a piston 28. Assembly 4 is well known and will not be described in detail. Two parallel rods 29 are linked at one end to an eccentric horizontal axis 30 on the lever 25 and at the other end to a horizontal axle 31 mounted in the right end of piston 14. Axles 20 and 31 and stops 12 are parallel and are contained in median horizontal plane Q of the door closure.

The operation is as follows.

The casing of the door closure is installed, for example, in the upper portion of a door frame, the lower end of spindle 8 being attached to the door at its axis of rotation.

Upon the opening of the door in a first direction, pinion 9 turns in a clockwise direction as indicated by arrow f (FIG. 4) pulling with it rack 10, which slides to the right, and rack 11, which slides in the opposite direction. Because of its sliding, rack 10 pushes directly against piston 14, which also slides to the right. Rods 29 then cause lever 25 to turn in a clockwise direction (arrow g FIG. 3) which, on the one hand, compresses spring 26 and, on the other hand, displaces shock absorber piston 28 to the right in its cylinder. This opening movement is limited by the abutment of rack 11 against the wall of the left end of case 5.

When rack 10 comes into contact with piston 14, its stop 12 is just behind hook 24 of lever 21, below arm 23 of the latter. As soon as piston 14 begins to slide, arm 22 of lever 21 moves away from stop 17, which allows lever 21 to pivot counterclockwise under the influence of gravity and bring arm 23 against stop 12 of rack 10. As the sliding continues, the bent upper end 22*a* of arm 22 slides along metal strip 16 and assures that hook 24 can no longer rise and remains engaged with stop 12.

When the door is released, spring 26 urges lever 25 to turn in the direction opposite arrow g, and this rotation is slowed by shock-absorber 27, the speed of the return being adjustable. The rotation of lever 25 in the direction opposite arrow g causes piston 14 to be pushed to the left by rods 29; piston 14 in turn pushes rack 10 toward the left, which causes pinion 9 to turn in the direction opposite arrow f, assuring that the door closes. At the end of the closing movement, arm 22 of lever 21 meets stop 17, which causes it to rise up and returns lever 21 to its original position as in FIG. 1. During this movement, hook 24 frees stop 12. The bent end 22*a* of arm 22 crosses an opening of stop 17 to allow lever 21 to swing.

The opening of the door in the other direction brings about the same operation of the door closure, but under the influence of rack 11, its stop 12 catching in hook 24.

In the case of closing the door at a faster speed than the preadjusted return speed assured by assembly 4, pinion 9 becomes the motor for the closing movement, so that the rack under consideration tends to move away from piston 14. However, stop 12, caught in hook 24, prevents this separation, so that piston 14 is pulled by the rack and pulls with it rods 29, lever 25 and shock absorber piston 28, which slows the movement. Shock absorber 27 can, as is known, comprise an oil pressure limiting device which permits an increase in the displacement speed of piston 28 in such a case.

Of course, shock absorber 27 can also be provided with means to permit the sudden acceleration of movement at the end of a closing movement, in order to guarantee the complete closing of the door and, in particular, the engagement of the door's lock.

As can be seen, during operation piston 14 always interlocks with the rack which is displaced towards the right, thanks to hook 24, whatever the rotational direction of pinion 9 may be and whatever the direction of the opening of the door may be.

Metal strip 16 can serve not only as a stop for lever 21, but also as a device for maintaining the door in an open position, or as a "door stop". Indeed, when cam 19 is retracted, metal strip 16 does not interfere with the trajectory of pin 32 held by piston 14. However, if desired, it is possible to place cam 19 in an angular position in which it pushes the right portion of strip 16 down. In this case, groove 18 latches elastically on pin 32 at the end of the opening stroke, which holds the door open.

Figure 5:
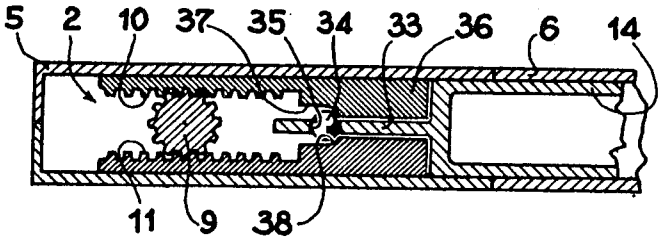
FIGS. 5 and 6 are partial views of a variant analogous to FIG. 2.
Figure 6:
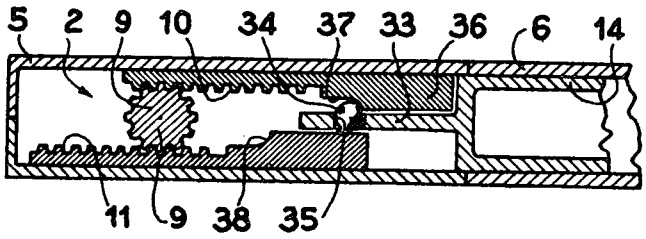

FIGS. 5 and 6 show a variant of the device for the selective linkage of racks 10 and 11 and piston 14. In this embodiment, lever 21 is replaced by longitudinal rod 33 which extends piston 14 toward the left and which is rigidly attached to the latter. Rotatable pin 34 freely traverses hole 35 provided at the end of rod 33. Each rack has at its right end a block portion 36 which protrudes toward the other rack, the space between the two blocks being less than the diameter of pin 34. A groove 37 with a straight portion and a rounded bottom 38 is formed in the left end of each block portion 36.

At rest, pin 34 faces the two grooves 37 which hold it in hole 35. Under the influence of the displacement of rack 11 toward the left, pin 34 is pushed toward rack 10 by bottom 38 of groove 37 of rack 11 and lodges itself at the bottom of groove 37 of rack 10, which assures the engagement of piston 14 with rack 10 which moves toward the right. Except for this difference, the door closure and its operation are identical to what has been described above in regard to FIGS. 1 to 4.

As a variant, pin 34 can be replaced by an appropriately shaped mobile element other than a cylinder or sphere, allowing one, for example, to obtain a more rapid engagement of the piston with the rack at the beginning of the opening.

What is claimed is:

1. In a double-action door-closure mechanism including a spindle whose rotation is linked to the opening movement of a door and to a door restoration assembly which includes a rotatable lever means coupled to a return spring and to a shock absorber, the improvement comprising:

a rack and pinion assembly comprising a pinion formed on the spindle, and two oppositely facing parallel racks permanently meshing with said pinion so that the racks slide in opposite directions for opposite opening directions, respectively, of the door; and selective linkage means, coupled to said rotatable lever means, for selectively engaging only a different one of said racks with said rotatable lever means during movement of the door in the opposite directions, respectively, and for disengaging the same at the end of a door-closing movement, so that only one rack engages said rotatable lever means for each opening and closing movement, and so that neither rack engages said lever means in the closed position of the door.

2. The improvement of claim 1 further comprising an elongated casing enclosing said rack and pinion assembly, said linkage means and said door restoration assembly, and wherein said linkage means comprises a piston longitudinally slidable in said casing between said restoration drive assembly and said rack and pinion assembly, one end of said piston being linked to said rotatable lever means and the other end being engageable by the operative rack.

3. The improvement as defined in claim 2 wherein said rack and pinion assembly is located in the rear end of said casing and wherein said restoration drive assembly is located in the forward end of said casing, and further comprising:

connecting rod means linking the forward end of said piston to said rotatable lever means;

stop means fixed to the forward end of each of said racks;

hook means pivotally mounted on the rear end of said piston and normally disposed in the path of the stop means of the operative rack for mechanically coupling said piston to said operative rack; and hook release means mounted in said casing for withdrawing said hook means from said path at the end of a closing movement of the door.

4. The improvement as defined in claim 3 wherein said hook means comprises an L-shaped lever having a first arm engageable by said release means and a second arm having a hook engageable by said stop means.

5. The improvement as defined in claim 4 wherein said stop means comprises a transversely extending stop pin on the forward end of each of said racks.

6. The improvement as defined in claim 2, 3, 4 or 5 further comprising a rotatable pin mounted in the surface of said piston, and flexible metal strip means mounted in said casing for engaging said rotatable pin to form a door stop at the end of the opening movement of a door.

7. The improvement as defined in claim 6 further comprising adjustable cam means in said casing for disengaging said flexible strip means from said rotatable pin.

8. The improvement as defined in claim 1 wherein said linkage means comprises hook means latched to the operative rack during the closing of the door, and hook release means mounted in the casing for unlatching said hook means at the end of a closing movement of the door.

9. The improvement as defined in claim 8 further comprising a rod fixed to said piston and extending longitudinally toward and between said racks, said racks containing complementary cam surfaces therein, and roller means loosely mounted in said rod and disposed between said cam surfaces in the closed position of the door, but being biased against the cam surface of the operative rack by the relative displacement of the racks upon opening of the door so that the operative rack is interlocked, via said roller means, with said piston during a closing movement of the door.

* * * * *